US005588904A

United States Patent [19]

Allport

[11] Patent Number: 5,588,904

[45] **Date of Patent: * Dec. 31, 1996**

[54] FINISHING TOOL

[76] Inventor: Anthony Allport, 2402 NE. 14th, Portland, Oreg. 97212

[ * ] Notice: The term of this patent shall not extend beyond the expiration date of Pat. No. 5,474,490.

[21] Appl. No.: 521,116

[22] Filed: Aug. 29, 1995

Related U.S. Application Data

[63] Continuation-in-part of Ser. No. 278,450, Jul. 21, 1994, Pat. No. 5,474,490.

[51] Int. Cl.[6] ..... B24D 17/00

[52] U.S. Cl. ..... 451/512; 451/514

[58] Field of Search ..... 451/512–515, 451/519, 523

[56] References Cited

U.S. PATENT DOCUMENTS

| | | | |
|---|---|---|---|
| 8,681 | 1/1852 | Copeland | 451/503 |
| 53,183 | 3/1866 | Fitch | 73/747 |
| 124,259 | 10/1878 | Fay | 451/503 |
| 445,212 | 1/1891 | West | 451/503 |
| 838,465 | 12/1906 | Seaborn | 451/515 |
| 840,982 | 1/1907 | Williams | 451/492 |
| 1,183,444 | 5/1916 | Fisk | 451/519 |
| 1,522,459 | 1/1925 | Jackowitz | 451/491 |
| 2,189,980 | 2/1940 | Forsblade | 451/503 |
| 2,220,727 | 11/1940 | Nordlund | 451/512 |
| 2,402,069 | 6/1946 | Minnick et al. | 451/514 |
| 2,527,089 | 6/1949 | Adams | 451/515 |
| 2,624,161 | 8/1951 | Snell | 451/512 |
| 2,982,059 | 5/1961 | Trussell | 451/503 |
| 4,320,601 | 3/1982 | Haney | 451/514 |
| 4,640,060 | 2/1987 | Lukianoff | 451/502 |
| 4,885,876 | 12/1989 | Henke | 51/393 |
| 5,474,490 | 12/1995 | Allport | 451/512 |

OTHER PUBLICATIONS

U.S. Patent classification Subclass Listing.
Excerpt from catalog entitled, "Trend Lines", dated Jan. 31, 1988 –375 Beacham St., Chelsea, MA 02150.
Letter published in magazine entitled, "Fine Woodworking Magazine", dated Jul./Aug. 1987, pp. 11 & 12.
Notes from meeting with third party on Jan. 21, 1992.

*Primary Examiner*—Bruce M. Kisliuk
*Assistant Examiner*—Andrew Weinberg

[57] ABSTRACT

A finishing tool useful in sanding, abrading and like activities. The tool comprises a block having slots of a predetermined size and shape disposed in opposite ends of the block. The slots are adapted to receive matching holding elements so that a predetermined length of finishing material, such as sandpaper, may be placed across the support surface of the block, the ends of sandpaper being inserted and securely held between the surfaces of the holding elements and the slots. The holding elements are pulled inwardly by retraction elements such as one or more lengths of an elastic material such as a rubber hose interconnecting the holding elements. Passages are provided in the block for housing such elastic members.

17 Claims, 3 Drawing Sheets

FINISHING TOOL

This is a continuation-in-part of application Ser. No. 08/278,450, filed Jul. 21, 1994 now U.S. Pat. No. 5,474,490.

BACKGROUND OF THE INVENTION

This invention relates to tools used in sanding, abrading or polishing of surfaces. More specifically, the invention relates to hand tools on which a sheet of polishing or abrading material can be mounted.

A common use for such a sanding, abrading or polishing hand tool is in the finishing of wood products. For purposes of brevity, herein the term "finishing" shall be understood generally to encompass all forms of sanding, abrading, polishing, buffing and like activities, and the invention described and claimed herein is referred to as a finishing tool. At the same time, use of the term finishing is not intended as a limitation on types of activities or uses to which the invention can be put.

Perhaps the most important step in creating a handcrafted wood product is the finishing step. Hand tools exist to hold sheeted finishing materials in place so that they may be used to give a surface, such as wood, a particular kind of texture. Such sheeted finishing materials include sandpaper, emery paper, polishing or rubbing cloth, or any desired sheeted finishing material to be rubbed against a surface as the block is operated.

With the advent of diverse, high quality abrasives, sanding has become a particularly important process both for shaping surfaces and preparing them for finishing. Many power tools have evolved to facilitate this process, but hand sanding remains an indispensable component of most finishing jobs. Indeed, it has long been known that a sanding block greatly increases the efficiency of hand sanding by fully and evenly utilizing the sandpaper supported on the surface of the sanding block. A sanding block also facilitates hand sanding by providing a comfortable and convenient handle or grip with which to manipulate the sandpaper attached to the block.

The principal elements of an effective finishing tool for use as a sanding block are:

(1) a surface that will support sandpaper and uniformly apply it to the work surface;

(2) a means for attaching the sandpaper to the support surface securely, efficiently, inexpensively, safely and conveniently, so the sandpaper can be easily removed and replaced when desired; and (3) a handle which allows comfortable and convenient manipulation of the tool.

Thence, in one respect a finishing tool must be capable of firmly and tautly holding sheeted finishing material against the support surface of the tool so that the sheeted finishing material does not move or break free when the finishing tool is subjected to the forces and repetitive motions of sanding. Inadequately held sheeted finishing material can break or tear, resulting in uneven and less effective finishing, wasted time and increased costs.

In another respect, somewhat inconsistent with the objective of firmly attaching the sheeted finishing material to the finishing tool, the sheeted finishing material should be easily removable from the tool to substitute fresh or different sheeted finishing material. Sheeted material can lose effectiveness when it becomes clogged with debris, worn down or torn as it is used. In addition, sometimes during the finishing process it is desirable to change grades or kinds of sheeted finishing material. Not only must sheeted finishing material be easily removed, but the new sheeted finishing material must also be placed into a firm and taut position on the tool with a minimum of effort.

Three basic concepts have been long employed in sanding blocks. The first concept is that of wrapping a piece of sandpaper around a rectilinear block and holding it tight against the block with pressure from your hand. The second concept is to employ a block on which a strip of sandpaper is wrapped upwardly around the ends and impaled on pins or nails sticking upwardly out of the block, the nails in turn being covered either by a rubber flap which must be bent back to expose the pins or by a plastic casing which snaps over the entire top of the block. The third concept is that of using a mild adhesive to glue sandpaper to the bottom of the sanding block so that it can be peeled off and replaced when it is worn out.

All of the three types of commercially available sanding blocks have their drawbacks. The rectilinear block is the simplest and it can be effective in the hands of an experienced craftsman, but it does require a high degree of skill, coordination and strength to keep the assembly together. Even in the hands of a skilled operator it is fatiguing to use, as a constant firm grip is required.

The blocks that use pins to secure the sandpaper have the drawback that the paper can never be pulled tight across the surface of the block. There is always a little bit of play in the paper when it is mounted. This allows the sandpaper to work back and forth while the block is being used, causing the paper to wear out faster and wasting energy in the process.

Also the pins can prick the operator while removing and replacing the paper. The rubber flaps used on such blocks are also problems in that they are prone to break from bending back to expose the pins. The rubber flaps are also difficult to hold back when installing.

Blocks employing adhesives to secure the paper have their problems too. First, only specialized expensive paper can be used. Second, the required paper is not as widely available as conventional sandpaper. Third, the adhesive surfaces tend to load up with sanding dust causing the adhesive quality to deteriorate.

Attempts have been made to improve on the foregoing concepts but none have been entirely successful. For example, sanding blocks that permit easy and convenient changing of sand paper tend not to hold the sandpaper securely and tautly; while sanding blocks that securely and tautly hold sand paper tend not to permit easy and convenient changing of the sandpaper.

One prior art finishing tool is seen in F. Schuch, *Fine Woodworking Magazine*, July/August, 1987, pp 11–12. Schuch proposes a solid slab of wood with shallow "v-groove" notches along the lengths of opposite edges. A length of wood doweling can fit into each v-groove to clamp the edges of a piece of sandpaper into respective v-grooves. Both ends of each wood dowel extend beyond the width of the wood slab. Strips of inner tube connect the extending ends of opposing dowels to keep the dowels clamped against the sandpaper in the v-grooves. However, if held by hand and reciprocated, the wood doweling is likely to be dislodged from the v-grooves as a result of direct hand contact with the dowels or the external rubber strips.

Another prior art finishing tool is proposed by Fisk, U.S. Pat. No. 1,183,444. Fisk uses spring-driven clamping mechanisms imbedded in a base to secure sandpaper ends. Since each clamping mechanism is located on the top surface of the sanding base, gripping and putting pressure on the device during use could engage the spring, thereby loosening the sandpaper. Further, being embedded in the base, the clamping mechanism is not optimally located for efficient insertion and removal of sanding paper.

Forsblade U.S. Pat. No. 2,189,980 proposes a hinged assembly of two blocks, the adjacent faces of which are forced apart on one side of the hinge by a wedge while the same faces come together on the other side of the hinge in a pinching motion. This allows for the mounting of sheet abrasive on both outside faces of the hinged blocks, but it is not adapted in any way to provide a comfortable grip or handle. The Forsblade device is also an unnecessarily complicated and expensive product to build. Further, the wedge is subject to dislocation and loss.

Nordlund U.S. Pat. No. 2,220,727 proposes a tool employing a wedge to draw two blocks tightly together. This tool provides a comfortable grip, but the wedge is subject to easy displacement during use. The three parts can become separated and lost, and the open edge of the sandpaper is exposed to the forward and backward motion of the block. This allows dust and debris to get between the paper and the block, spoiling the uniformity of the finish and causing the paper to break down, tear and fold.

In addition to having structural and functional disadvantages many prior art finishing tools are unduly expensive or difficult to manufacture. An example of such tools are the aforementioned tool proposed by Nordlund and the tool proposed by Minnick et al, U.S. Pat. No. 2,402,009, which has elaborate hinges and structure.

Therefore, it can be seen that there is a need for a finishing tool which provides improved attachment and removal of sheeted finishing material, handling and finishing results.

SUMMARY OF INVENTION

The present invention overcomes the disadvantages in the prior art by providing a finishing tool comprising a block having a finishing material support surface, two opposing ends, and respective slots disposed in said opposing ends, respective holding elements adapted to fit into the slots, and retraction elements for pulling the holding elements into the respective slots and thereby secure respective ends of sheeted finishing material therein. Preferably, the slots are inwardly tapered and the holding elements are wedge-shaped. Preferably, the retraction elements comprise a pair of elastic members connected at each end respectively to said holding members.

Longitudinal passages are provided in the upper block to receive the elastic members and a lateral element is disposed in the longitudinal passages to hold the elastic members in their respective longitudinal passages. Preferably, the portion of the block below the slots extends beyond the portion of the block above the slots. Fingergrips, such as indentations in the holding element or protrusions therefrom, may be provided on the holding elements to make retraction and insertion easier. Cushioning material may be attached to the finishing material support surface for receiving a sheet of finishing material.

In another aspect, the respective holding elements comprise one or more guide elements. Each guide element is shaped and has dimensions so as to conform to a corresponding alignment guide. Having said guide elements and alignment guides, each holding element is easily aligned with the corresponding slot and, when pulled into the corresponding slot by the retraction element, lateral protrusion of the holding element from the slot is minimized.

Therefore, it is a principal object of the present invention to provide a novel finishing tool that firmly and securely holds a sheet of finishing material in place.

It is another object of the present invention to provide a finishing tool in which sheet finishing material can be conveniently and rapidly attached and removed.

A further object of the present invention is to provide a finishing tool that is free of protruding parts.

Yet another object of the present invention is to provide a finishing tool wherein sheet finishing material is held tautly across a support surface.

Yet a further object of the present invention is to provide a finishing tool in which elements holding a sheet of finishing material are readily aligned with the tool elements that secure the holding elements.

The foregoing and other objects, features and advantages of the invention will be more readily understood upon consideration of the following detailed description of the invention, taken in conjunction with the accompanying drawings.

DETAILED DESCRIPTION OF THE INVENTION

Figure 1:
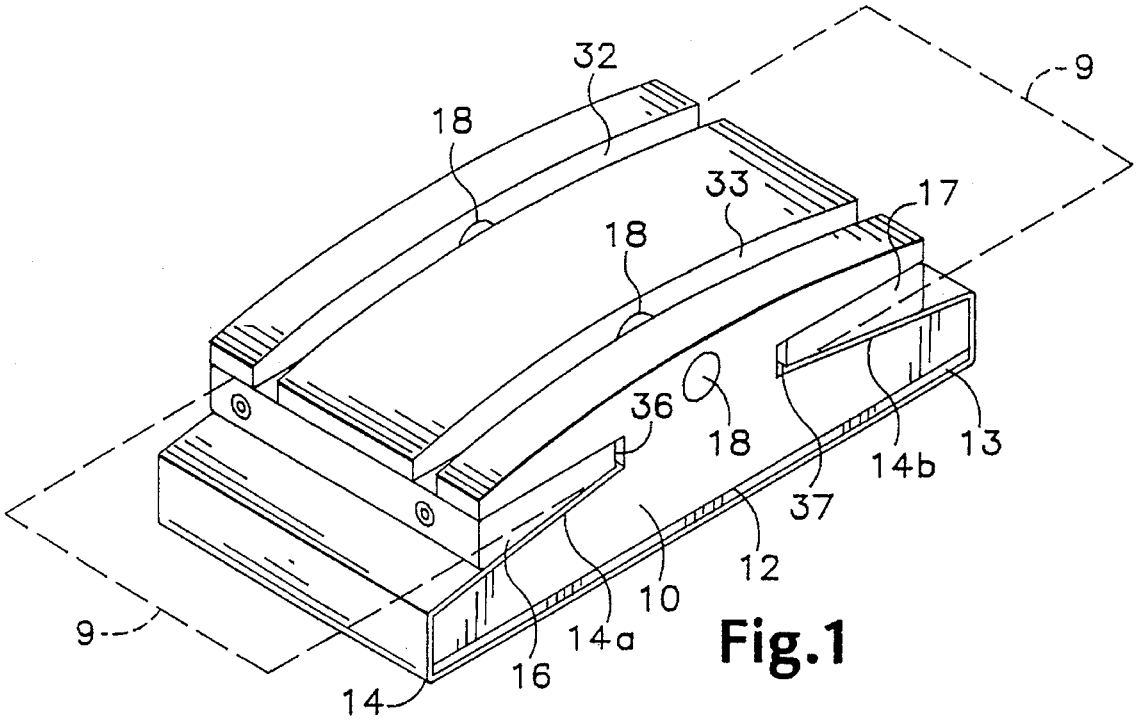
FIG. 1 is a perspective view of a finishing tool according to the present invention with sheeted finishing material attached thereto.

Referring first to FIG. 1, a preferred embodiment of the present invention comprises a block 10, having slots 36, 37 disposed in opposite ends thereof, the slots 36, 37 being adapted to receive removable holding elements 16, 17. Holding elements 16, 17 substantially match and conform to the size and space of the slots 36, 37. Preferably, slots 36, 37 are tapered toward their closed end, as seen in FIG. 1. Accordingly, holding elements 16, 17 are preferably wedge shaped to match the tapered slots. The portion of block 10 substantially above the plane 9 is referred to herein as the "upper block portion" 40, and the portion substantially below the plane 9 is referred to herein as the "lower block portion" 42. In addition to receiving holding elements 16, 17, slots 36, 37 are also adapted to receive end lengths 14*a*, 14*b* of removable sheeted finishing material 14. Typically, the sheeted finishing material comprises sandpaper.

Block 10 and holding elements 16, 17 may be constructed of wood, rubber or plastic, as well as any other material that can be easily shaped into the configurations contemplated for this invention. Such materials must have sufficient strength and rigidity to withstand the forces generated during polishing and abrading activities.

Lower block portion 42 has a support surface 12 for receiving a sheeted finishing material 14, such as sheet sandpaper. Typically, the surface will be planar; however, other support surface shapes may be selected for particular needs. A thin sheet of cushion material 13 may be bonded to support surface 12. Rubber and felt are exemplary, suitable cushion materials. To attach the finishing material securely and tautly to the support surface 12, finishing material 14 is provided with ends 14*a* and 14*b* which extend beyond the ends 11, 15 of support surface 12, wrap around ends 11, 15 and fit into slots 36, 37, respectively. Ends 14*a*, 14*b* of sheeted finishing material 14 are held in place in slots 36, 37 by holding elements 16, 17, which are inserted into slots 36, 37 after the ends of sheeted finishing material have been placed therein. Indented or protruding fingergrips such as fingergrip 19 in FIG. 3 and fingergrip 90 in FIG. 8 may be disposed on the sides of holding elements 16, 17 to improve the ease with which the holding elements may be manipulated by the user's fingers.

Figure 4:
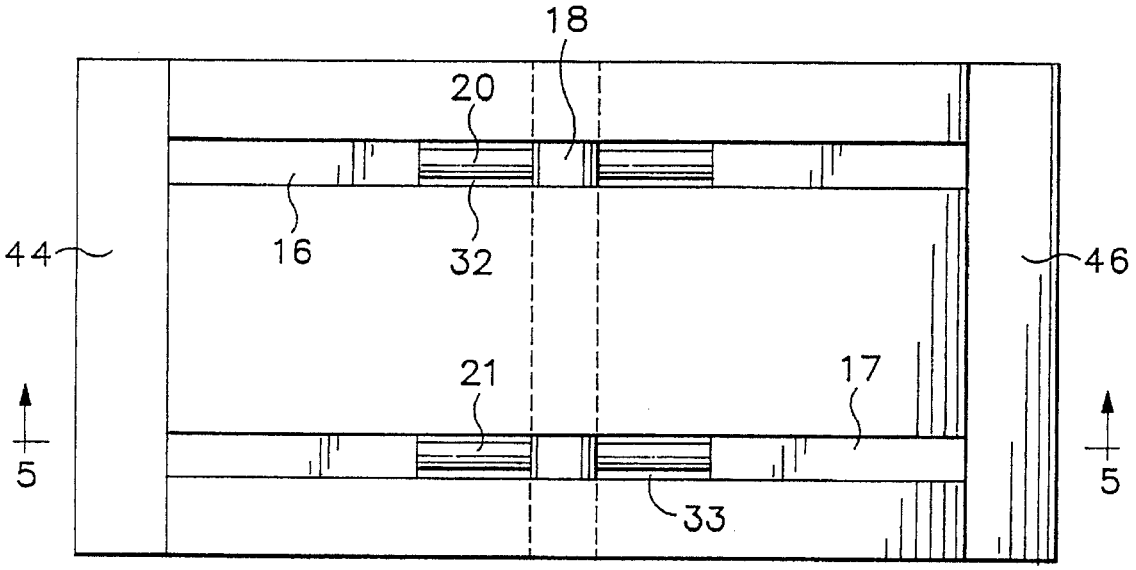
FIG. 4 is a plan view of the embodiment shown in FIG. 1.
Figure 5:
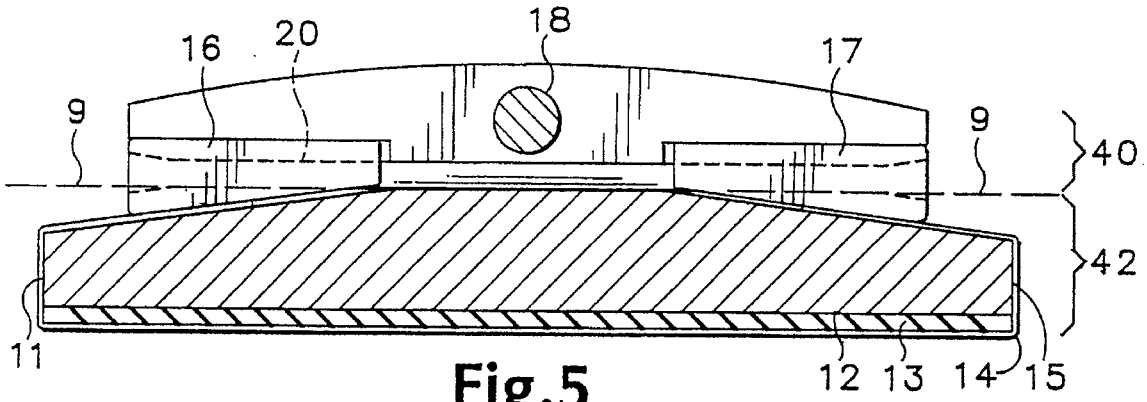
FIG. 5 is a section taken along line 5—5 of FIG. 4.
Figure 6:
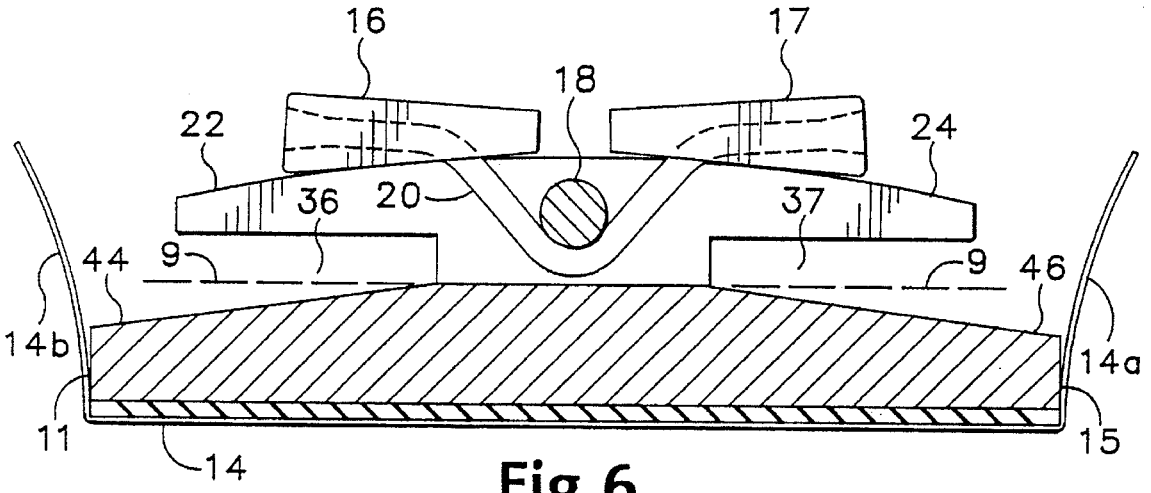
FIG. 6 is a section taken along line 5—5 of FIG. 4, showing holding elements removed from their respective slots and parked on the upper block portion of the tool and end portion of the sheeted finishing material ready to be positioned in the tool.

Preferably, as shown in FIGS. 4, 5 and 6, ends 11, 15 of lower block portion 40 extend beyond the ends 22, 24 of upper block portion 42. This extension expands the area of the support surface 12 and provides surfaces 44, 46 leading into slots 36, 37 for guiding holding elements 16, 17 into the slots.

Figure 2:
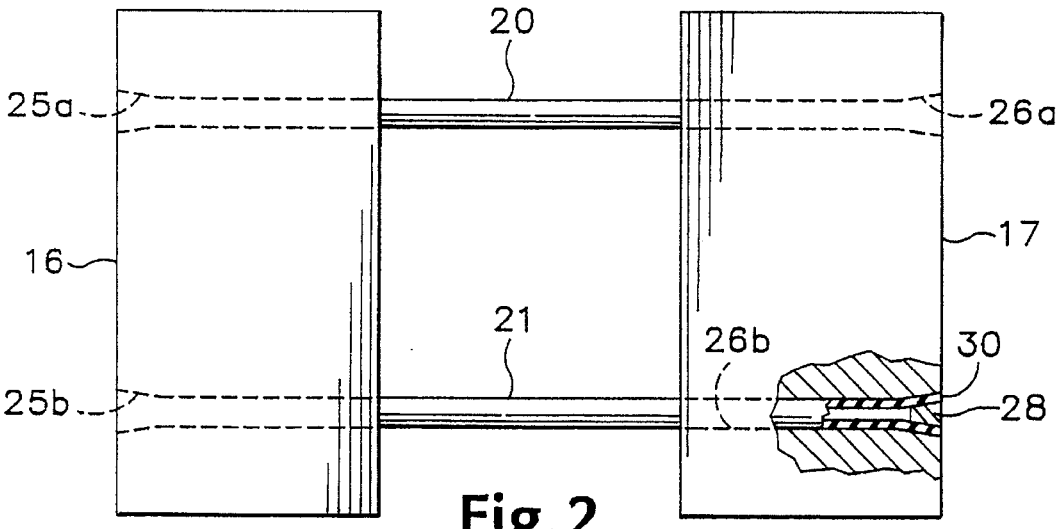
FIG. 2 is a plan view of holding element and retraction element portions of the embodiment of the invention shown in FIG. 1.
Figure 3:
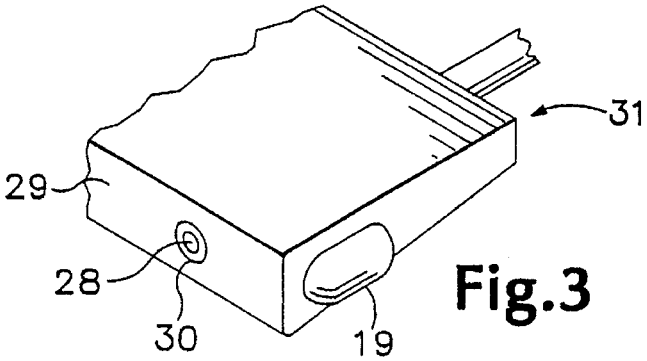
FIG. 3 is a perspective, cut-away view of a holding element and retraction element member of the embodiment of the invention shown in FIGS. 1 and 2, together with a fingergrip disposed on the side of the holding element.

Retraction elements are preferably employed as shown in FIGS. 2 and 3. Holding element 16 is interconnected by one or more elastic members 20, 21 to a point in or on the finishing tool forward of the closed end of slot 36, including some point on block 10 or on an opposing holding element 17. Longitudinal passages 32, 33 are provided to house each elastic member. Preferably, holding element 16 is interconnected to opposing holding element 17 by two longitudinal elastic retraction members 20, 21 in the manner shown in FIGS. 2 and 4.

Elastic members 20, 21 preferably each comprise a length of rubber, for example, rubber surgical hose. Holding elements 16, 17 contain passages 25*a,b* and 26*a,b*, respectively, for receiving elastic members 20, 21. Each elastic member is attached to a fastener, such as fasteners 28, that secures elastic members 20, 21 to holding elements 16, 17. The fastener should be a device suitable for securing an elastic member to a holding element and another point on the finishing tool.

While there are many possible ways for connecting an elastic member to a holding element, FIG. 2 shows a preferred connection assembly. In this embodiment, elastic member 21 comprises a rubber hose. The hose enters holding element passage 26*b* through the front end 29 of holding element 17 and passes out the opposite end 31 of the holding element. At end 29, passage 26*b* has an outwardly tapered opening 30. A fastener 28 comprising, for example, a short segment of a wood dowel, is inserted into a predetermined length of the rubber hose 21 extending out of opening 26*b*. Once the dowel segment is inserted, the composite structure is placed in opening 30. Fastener 28 and surrounding hose 21 should have a composite shape and size that will tightly fit into tapered opening 30 without pulling through passage 26*b*. The end of rubber hose 21 is thereby secured and held between the fastener 28 and inner surface of the tapered opening 30.

In a relaxed state, elastic members 20, 21 should have a length that is less than the distance between the interconnection points on holding element 16 and holding element 17, respectively, when each holding element is in its slot 36, 37. In other words, when interconnected, elastic members 20, 21 are in a stretched state and will tend to pull holding elements 16, 17 into slots 36, 37, respectively, and hold them in place, as shown in FIG. 5. Elastic members 20, 21 should also be of sufficient length that holding elements 16, 17 can easily be retracted from slots 36, 37 without exceeding the elastic limits of elastic members 20, 21 or risking breakage thereof.

Referring particularly to FIGS. 1 and 4, longitudinal passages 32, 33 are provided in block 10 for receiving elastic members 20, 21 in the block. Passages 32, 33 are formed in upper block portion 40, and are bounded by the upper surface of lower block portion 42 and are open through the surface of upper block portion 40. Passages 32, 33 also communicate with slots 36, 37. The width of passages 32, 33 should be at least large enough to allow elastic members 20, 21, which are longitudinally aligned with passages 32, 33, to travel vertically through the passages 33, as shown in FIG. 6. Preferably the passage width is just slightly greater than the width or diameter of elastic members 20, 21 so that elastic members 20, 21 can snugly, but easily, travel through passages 32, 33.

Holding elements 16, 17 may be retracted from slots 36, 37 and conveniently parked on the top surface of the upper block portion during changing of sheeted finishing material 14, as depicted in FIG. 6. To do this, holding element 16 is pulled backwards, stretching elastic members 20, 21. Once stretched clear of slot 36, holding member 16 is moved above the top surface of the upper block toward the center of the upper block. A retaining member 18 runs across passages 32, 33 but does not block them. Retaining member 18 prevents the elastic members and holding elements from separating from block 10, as shown by FIG. 6. A preferred retaining member 18 may be a component of the block 10, or other material, such as a segment of a wood dowel. Retaining member 18 keeps the elastic members 20, 21 from completely leaving passages 32, 33. By providing a length of elastic members 20, 21 such that they are in a stretched state when holding elements 16, 17 are moved above the upper block 40, the holding elements 16, 17 will be held there. That condition permits finishing material 14 to be added or changed without interference from dangling holding elements. After ends 14*a,b* of sheeted material 14 are added to or removed from slots 36, 37, holding elements 16, 17 may be returned to the slots.

While rubber surgical tubing has been shown as the material for elastic members 20, 21, they may comprise any number of elastic materials, including rubber cords, rubber hoses and metallic springs without departing from the principles of this invention. Any material chosen should be capable of withstanding repeated cycles of stretching-relaxation. The material should also be easily stretchable by hand, yet capable of retracting holding elements 16, 17 into their slots 36, 37 and retaining them there.

Figure 7:
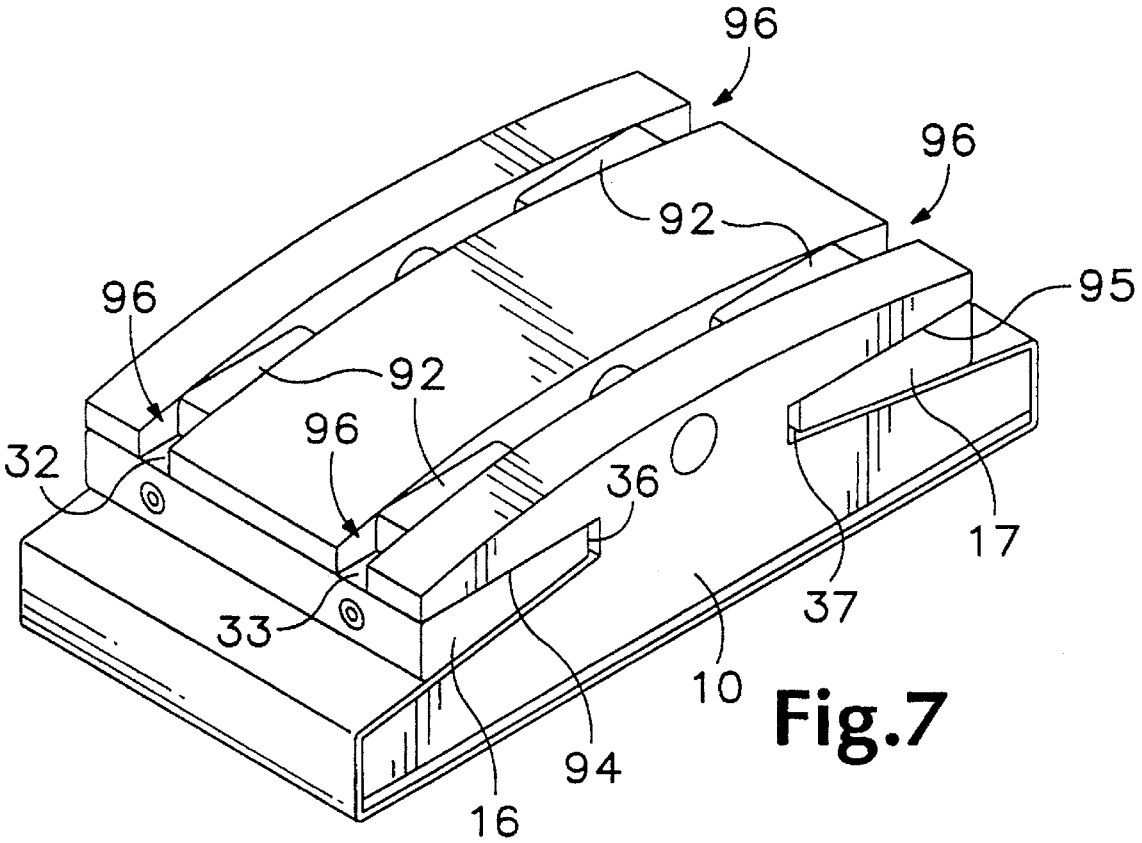
FIG. 7 is a perspective view of another embodiment of a finishing tool according to the present invention.
Figure 8:
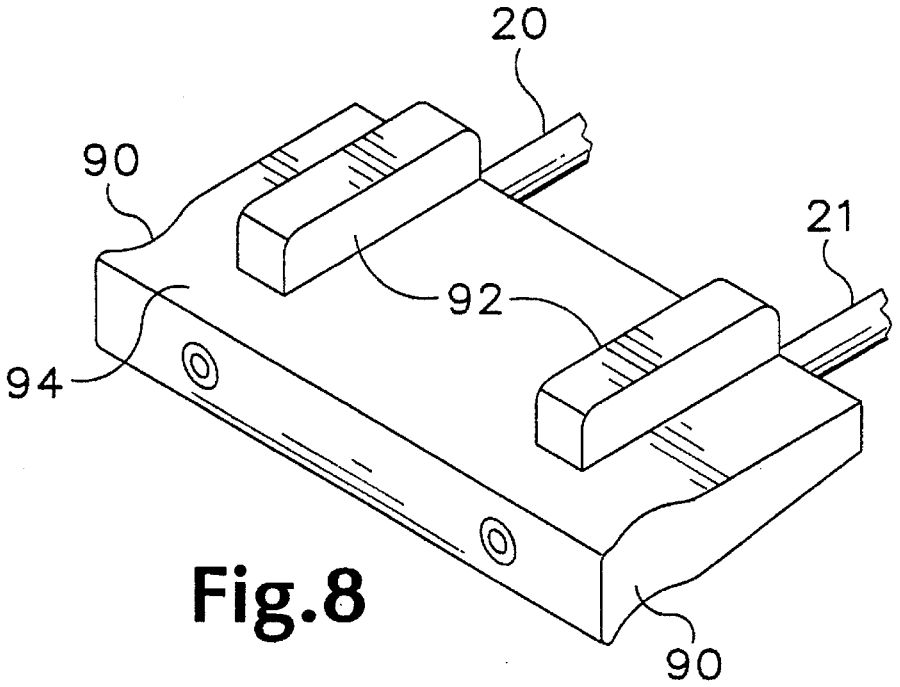
FIG. 8 is a perspective, cut-away view of a holding element, a guide element, an alignment guide and a retraction element of the finishing tool of FIG. 7, together with fingergrips disposed in opposite sides of the holding element.

Referring to FIGS. 7 and 8, an alternative embodiment of a finishing tool according to the present invention includes holding elements 16, 17 having one or more guide elements 92. The guide elements 92 preferably comprise protrusions disposed on the top sides 94 and 95 of the holding elements 16 and 17. However, it is to be recognized that other structure or disposition, or both, can be used without departing from the principles of the invention.

The guide elements 92 can be formed integrally with the respective holding elements 16, 17. Alternatively, the guide elements 92 can be formed separately from and attached to the respective holding elements 16, 17. It is to be recognized that the guide elements 92 can be formed in any way suitable to their function, without departing from the principles of the invention.

The guide elements 92 preferably cooperate with one or more alignment guides 96, and are shaped and have dimensions which conform to the corresponding alignment guides 96. As shown, the alignment guides 96 preferably comprise the longitudinal passages 32, 33 of the block 10. It is to be recognized, however, that the alignment guides 96 can comprise structure other than the passages 32, 33, without departing from the principles of the invention. For example, the alignment guides can comprise protrusions or other structure so long as the guide elements 92 conform thereto to accomplish the alignment function.

In operation, the guide elements 92 are aligned with the corresponding alignment guides 16 by positioning the respective holding element 16 or 17 away from the block 10. Once so aligned, the elements 16 and 17 are inserted in the corresponding slots 36, 37. As shown, the insertion is accomplished by releasing the element 16 or 17 so that the retraction element, e.g. elastic retraction members 20 and 21, pull the holding elements 16, 17 into the corresponding slots 36, 37. In the insertion step, the guide elements 92 travel conformably in association with the corresponding alignment guides 96 so that, when the holding elements 16, 17 are received in the slots 36, 37, the sides 97 of the holding elements 16, 17 are substantially laterally aligned with the sides 98 of the slots 36, 37. That is, the cooperation of the guide elements 92 and the alignment guides 96 minimizes lateral protrusion of the elements 16, 17 from the slots 36, 37 and, thereby, minimizes the need for any additional lateral alignment of the holding elements 16, 17 relative to the slots 36, 37 after the holding elements are received in the slots.

Cooperation between the guide elements 92 and alignment guides 96 also reinforces the ability of the holding elements 16, 17 to withstand forces generated in using the tool and, thereby, to remain alignably received in the slots 36, 37. It is to be recognized that the guide elements 92 may be shaped and dimensioned so that the retraction elements pull the holding elements 16, 17 into the corresponding slots 36, 37 without requiring the user to alignably position each of the guide elements 92 with the respective alignment guide 96.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A finishing tool, comprising:

a block;

a first holding element having a lateral side;

a first slot disposed in said block and having a lateral side, said first slot for receiving said first holding element; and a guide element, said guide element cooperating with said first holding element so that, when said first holding element is received in said first slot, said lateral side of said first holding element is substantially laterally aligned with said lateral side of said first slot.

2. The finishing tool of claim 1, further comprising a retraction element associated with said first holding element so as to pull said first holding element into said first slot.

3. The finishing tool of claim 2, wherein said retraction element is secured to said first holding element and to said block and extends therebetween through said first slot.

4. The finishing tool of claim 1, further comprising an alignment guide, said alignment guide being associated with said block and cooperating with said guide element in said laterally aligning said first holding element and said first slot.

5. The finishing tool of claim 4, wherein said guide element is shaped and has dimensions conforming to said alignment guide.

6. The finishing tool of claim 4, wherein said block has a longitudinal passage and said alignment guide is provided by said longitudinal passage.

7. The finishing tool of claim 6, wherein said first holding element has a top side and said guide element comprises a protrusion disposed on said top side so as to extend into said longitudinal passage when said first holding element is inserted into said first slot.

8. The finishing tool of claim 1, wherein said guide element is formed integrally with said first holding element.

9. The finishing tool of claim 1, wherein said guide element is formed separately from, and attached to, said first holding element.

10. The finishing tool of claim 1, further comprising:

a second holding element having a lateral side;

a second slot disposed in said block opposite said first slot and having a lateral side, said second slot for receiving said second holding element; and an additional guide element, said additional guide element cooperating with said second holding element so that, when said second holding element is received in said second slot, said lateral side of said second holding element is substantially laterally aligned with said lateral side of said second slot.

11. The finishing tool of claim 10, further comprising a retraction element associated with said first and second holding elements so as to pull said first and second holding elements into respective said first and second slots.

12. The finishing tool of claim 11, wherein said retraction element is secured to said first and second holding elements and extends therebetween through said first and second slots, connecting via a longitudinal passage disposed in said block.

13. The finishing tool of claim 12, further comprising an alignment guide, said alignment guide cooperating with said guide element in laterally aligning said second holding element and said slot, said alignment guide being provided by said longitudinal passage.

14. A method for securing replaceable finishing material to a finishing tool, comprising the steps of:

providing a block having an associated first holding element and a first slot, said first holding element being coupled to a retraction element so that said retraction element imparts on said first holding element a pulling force directed toward said first slot;

applying a backward force on said first holding element so as to overcome said pulling force of said retraction element and so that said first holding element is disposed substantially outside said first slot;

inserting a first length of finishing material in said first slot;

releasing said first holding element so that said retraction element pulls said first holding element into said first slot; and aligning said first holding element in said first slot by operation of a guide element.

15. The method of claim 14, wherein the operation of said guide element includes traveling of said guide element conformably in association with said alignment guide so that, when said holding element is received in the slot, lateral alignment is substantially accomplished of said first holding element in said first slot.

16. The method of claim 14, wherein said aligning step occurs substantially automatically upon release of said first holding element by selecting a proper shape for said guide element.

17. The method of claim 14, further comprising repeating the applying, inserting releasing and aligning steps as to a second holding element, a second slot, a second length of finishing material and a second guide element.

* * * * *